US005979168A

United States Patent [19]

Beekman

[11] Patent Number: 5,979,168

[45] Date of Patent: Nov. 9, 1999

[54] SINGLE-SOURCE GAS ACTUATION FOR SCREW COMPRESSOR SLIDE VALVE ASSEMBLY

[75] Inventor: Dennis M. Beekman, La Crosse, Wis.

[73] Assignee: American Standard Inc., Piscataway, N.J.

[21] Appl. No.: 08/892,987

[22] Filed: Jul. 15, 1997

[51] Int. Cl.[6] ..... F25B 49/02; F04B 49/02; F04C 18/16; F04C 29/10

[52] U.S. Cl. ..... 62/228.5; 418/1; 418/201.2; 418/DIG. 1; 417/310; 417/440

[58] Field of Search ..... 62/228.5; 417/310, 417/440; 418/1, 97, 100, 201.2, DIG. 1

[56] References Cited

U.S. PATENT DOCUMENTS

| | | | |
|---|---|---|---|
| 4,025,244 | 5/1977 | Sato | 418/87 |
| 4,076,461 | 2/1978 | Moody, Jr. et al. | 417/310 |
| 4,342,199 | 8/1982 | Shaw et al. | 62/133 |
| 4,747,755 | 5/1988 | Ohtsuki et al. | 417/282 |
| 5,509,273 | 4/1996 | Lakowske et al. | 62/228 |

FOREIGN PATENT DOCUMENTS

| | | | |
|---|---|---|---|
| 6424193 | 1/1989 | Japan | 418/201.2 |
| 1335024 | 10/1973 | United Kingdom | 418/201.2 |

OTHER PUBLICATIONS

Patent Abstracts of Japan, vol. 015, No. 134 (M–1099), Apr. 3, 1991 & JP 03 015693 A, Jan. 24, 1991.

Patent Abstracts of Japan, vol. 009, No. 333 (M–443), Dec. 27, 1985 & JP 60 164693 A, Aug. 27, 1985.

*Primary Examiner*—John J. Vrablik

*Attorney, Agent, or Firm*—William J. Beres; William O'Driscoll; Peter D. Ferguson

[57] ABSTRACT

The position of a screw compressor slide valve in a refrigeration system is controlled using compressor discharge gas sourced from a location where the gas is relatively oil-free and has undergone little or no pressure drop subsequent to its discharge from the compressor's working chamber.

32 Claims, 4 Drawing Sheets

SINGLE-SOURCE GAS ACTUATION FOR SCREW COMPRESSOR SLIDE VALVE ASSEMBLY

BACKGROUND OF THE INVENTION

The present invention relates to the compression of gas in a rotary compressor. More particularly, the present invention relates to control of the position of a slide valve in a refrigeration screw compressor by the use of compressor discharge gas sourced from a location where such discharge gas is relatively oil-free and has undergone little or no pressure drop subsequent to its discharge from the compressor's working chamber.

Compressors are used in refrigeration systems to raise the pressure of a refrigerant gas from an evaporator to a condenser pressure (more generically referred to as suction and discharge pressures respectively) which permits the use of the refrigerant to cool a desired medium. Many types of compressors, including rotary screw compressors, are used in such systems. Screw compressors most often employ male and female rotors mounted for rotation in a working chamber which consists of a volume shaped as a pair of parallel intersecting flat-ended cylinders closely toleranced to the exterior dimensions and shapes of the intermeshed screw rotors.

A screw compressor has low and high pressure ends which respectively define suction and discharge ports that open into the working chamber of the compressor. Refrigerant gas at suction pressure enters the suction port from a suction area at the low pressure end of the compressor and is delivered to a chevron-shaped compression pocket defined by the intermeshed rotors and the interior wall of the compressor's working chamber.

As the rotors rotate, the compression pocket is closed off from the suction port and gas compression occurs as the volume of the pocket decreases. The compression pocket is circumferentially and axially displaced to the high pressure end of the compressor by the rotation of the screw rotors and comes into communication with the discharge port. At that point, the now compressed refrigerant gas is discharged from the compressor's working chamber.

Screw compressors most typically employ slide valve arrangements by which the capacity of the compressor is controlled over a continuous operating range. The valve portion of a slide valve assembly is disposed within the rotor housing, which defines the compressor's working chamber, and certain surfaces of the valve portion of the slide valve assembly cooperate in the definition of the working chamber.

Slide valves are most typically axially moveable to expose a portion of the working chamber and the rotors therein to a location within the rotor housing of a screw compressor, other than the suction port, which is at suction pressure. As a slide valve opens to greater and greater degrees, a larger portion of the working chamber and the screw rotors disposed therein are exposed to suction pressure. The portion of the rotors and working chamber so exposed and the chevron shaped pockets they define are incapable of engaging in the compression process and the compressor's capacity is proportionately reduced. The positioning of a slide valve between the extremes of the full load and unload positions is relatively easily controlled as is, therefore, the capacity of both the compressor and the refrigeration system in which the compressor is employed.

Historically, screw compressor slide valves have been positioned hydraulically using oil which has a multiplicity of other uses within such compressors. In refrigeration chiller applications, such other uses include bearing lubrication and the injection of such oil into the working chamber of the compressor for sealing and cooling purposes.

Such oil is most typically sourced from an oil separator downstream of the compressor where discharge pressure is used to drive oil to compressor injection ports and bearing surfaces and to control the position of the compressor's slide valve. It will be noted however, in the context of the present invention, that the pressure in the oil separator will be somewhat reduced from the pressure of the gas as it issues from the compressor's working chamber as a result of the pressure drop the discharge gas will experience in its travel to the oil separator. In any case, however, the pressure differential between the relatively higher pressure source of the oil (the oil separator) and a location within the compressor which is at a relatively lower pressure is taken advantage of to drive oil from the separator to the location of its use in the compressor.

Once used for its intended purpose, such oil is typically vented to or drained from the location of its use to a relatively lower pressure location within the compressor or system in which the compressor is employed. Most commonly, such oil is vented to, drained to or is used, in the first instance, in a location which contains refrigerant gas which is at suction pressure or at some pressure which is intermediate compressor suction and discharge pressure.

Such oil mixes with and becomes entrained in the refrigerant gas which is found in the location to which it is vented, drained or used and is delivered back to the oil separator in the stream of compressed refrigerant gas discharged from the compressor. Such oil, which comprises a relatively large percentage by weight of the gas-oil mixture discharged from the working chamber of a screw compressor, is separated from the refrigerant gas in the oil separator and is deposited in the sump therein. It is then re-directed back to the compressor locations identified above, under the impetus of the pressure in the oil separator for re-use.

Even after the separation process has occurred, oil in the sump of an oil separator will contain refrigerant gas bubbles and/or quantities of dissolved refrigerant. The separated oil may, in fact, contain as much as 10–30% refrigerant by weight depending upon the solubility properties of the particular oil and refrigerant used.

One difficulty and disadvantage in the use of oil sourced from the oil separator to hydraulically position the slide valve in a screw compressor relates to the fact that the oil will, as noted immediately above, typically contain dissolved refrigerant and/or bubbles of refrigerant gas. As a result of the use of such fluid to hydraulically position the piston by which a compressor slide valve is actuated, slide valve response can be inconsistent, erratic and/or slide valve position can drift as dissolved refrigerant entrained in the hydraulic fluid vaporizes (so-called "out-gassing") or as entrained refrigerant gas bubbles collapse.

The out-gassing of refrigerant from the hydraulic fluid, which most often occurs when the pressure in the cylinder in which the slide valve actuating piston is housed is vented to unload the compressor, and/or the collapse of refrigerant gas bubbles entrained in such hydraulic fluid causes a volumetric change in that fluid. That, in turn, affects the ability of the fluid to maintain the slide valve in a desired position or to properly position the slide valve in the first instance.

Still another disadvantage of the use of oil to position the slide valve in a refrigeration screw compressor relates to the fact that the quantity of refrigerant gas bubbles and dissolved liquid refrigerant contained therein varies with time and with the characteristics and composition of the particular batch of lubricant delivered to the slide valve actuating cylinder. In that regard, slide valves are most typically controlled through a supposition that the opening of a load or unload solenoid valve for a predetermined period of time results in the movement of a predetermined volume of hydraulic fluid to or from the slide valve actuating cylinder and slide valve movement that is repeatable and consistent with that period of time. That supposition is, in turn, predicated on the further supposition that the characteristics and composition of the hydraulic fluid directed to or vented from the slide valve actuating cylinder during such a period of time is consistent.

Because of the inconsistency in the characteristics and composition of the fluid supplied to and vented from hydraulically actuated slide valve actuating cylinders with respect to the nature and amount of refrigerant contained therein, slide valve movement during any particular time period may not be precisely consistent, repeatable or predictable. This lack of consistency and repeatability, from the control standpoint, is disadvantageous and reduces the efficiency of the compressor and chiller in which it is employed.

As will be appreciated from the content of U.S. Pat. No. 5,519,273 and U.S. patent application Ser. No. 08/763,775, U.S. Pat. No. 5,832,737, both assigned to the assignee of the present invention and both incorporated herein by reference, arrangements for controlling slide valve position in a screw compressor by the use of a gaseous medium of more uniform consistency rather than a hydraulic medium offer significant advantages. Arrangements are disclosed in that patent and patent application which source gas from one or both of at least two sources of gas within the compressor or the system in which the compressor is employed.

Testing on screw compressors using the arrangements set forth in the above-referenced patent and patent application have suggested that the sourcing of refrigerant gas to actuate the compressors slide valve from the discharge area or plenum, without more and as is taught in both instances, while superior in many respects to hydraulic actuation arrangements, may result in the admission of discharge gas to the slide valve actuating cylinder which contains certain amounts of oil. Excessive oil in such gas makes slide valve control and response more difficult and inconsistent than would be preferred, even though still superior to the consistency of response achieved in hydraulically actuated systems. Further, such arrangements have suggested the need to source gas from at least two rather than a single source of gas at sufficiently high pressure to assure the availability of gas for slide valve actuation purposes under all circumstances within the operating envelope of the chiller in which the compressor is employed. The need for dual gas sources renders such arrangements more complicated and expensive to manufacture and control.

The need therefore exists for an arrangement by which to control the position of a slide valve in a refrigeration screw compressor by the use of a gaseous medium that eliminates the disadvantages associated with the use of hydraulic fluid to do so, that permits more precise and consistent control of the slide valve position, that eliminates moving parts that can, through breakage or wear, lead to loss of or reduced slide valve control and that employs a readily available, single-source of relatively oil-free gas which is reliably at a high enough pressure to ensure that slide valve actuation occurs under the foreseeable operating condition of the refrigeration system in which the compressor is employed.

SUMMARY OF THE INVENTION

It is an object of the present invention to control the position of a slide valve in a screw compressor using gas rather than a hydraulic fluid.

It is a further object of the present invention to provide an arrangement by which reliable and precise control of the position of a slide valve in a screw compressor is achieved, using gas as an actuating medium, under all conditions within the operating envelope of the chiller in which the compressor is employed.

It is a further object of the present invention to employ refrigerant gas rather than hydraulic fluid in the positioning of a slide valve in a refrigeration screw compressor to ensure that the quantity and consistency of the actuating fluid delivered to or vented from the slide valve actuating cylinder during a predetermined period of time is both repeatable and consistent.

It is a further object of the present invention to control the position of a slide valve in a screw compressor using relatively oil-free compressor discharge gas sourced from a single location where such gas has undergone relatively little or no pressure drop subsequent to its discharge from the compressor's working chamber.

These and other objects of the present invention, which will be appreciated when the following Description of the Preferred Embodiment and the Drawing Figures are considered, are achieved in a screw compressor having a slide valve the position of which is controlled through the use of the gas discharged from the compressor's working chamber. The gas is sourced downstream of the compressor's discharge port at a location where relatively oil-free discharge gas is found to exist and where pressure drop in the gas has not occurred or is only relatively nominal.

By sourcing slide valve actuating gas from a location in which compressor discharge gas is relatively oil-free, a more "pure" gas is made available for slide valve control which eliminates the inconsistent slide valve response that can result when the gas used to actuate the slide valve contains more than nominal amounts of oil. By sourcing such gas from a location immediately downstream of the compressor's working chamber and proximate to the compressor's discharge port, the slide valve is actuated by gas in which pressure drop has not yet had a chance to occur or is only nominal. That, in turn, assures a source of relatively very pure and consistent slide valve actuating fluid, at a sufficiently high pressure under foreseeable compressor operating conditions, to assure proper and precise slide valve actuation and control, even when low head conditions exist such as at compressor start-up. As such, the need to use hydraulic fluid in which refrigerant is contained or to source gaseous slide valve actuation fluid from more than one location in order to assure that the compressor can be loaded under all conditions is eliminated with the result that the slide valve actuating control scheme and physical arrangement can be significantly simplified. The net result is a simplified, precise, consistent and reliable slide valve actuating arrangement for screw compressors which uses relatively oil-free discharge gas sourced from a single location and a refrigeration system of optimized efficiency.

DESCRIPTION OF THE DRAWING FIGURES

DESCRIPTION OF THE PREFERRED EMBODIMENT

Figure 1:
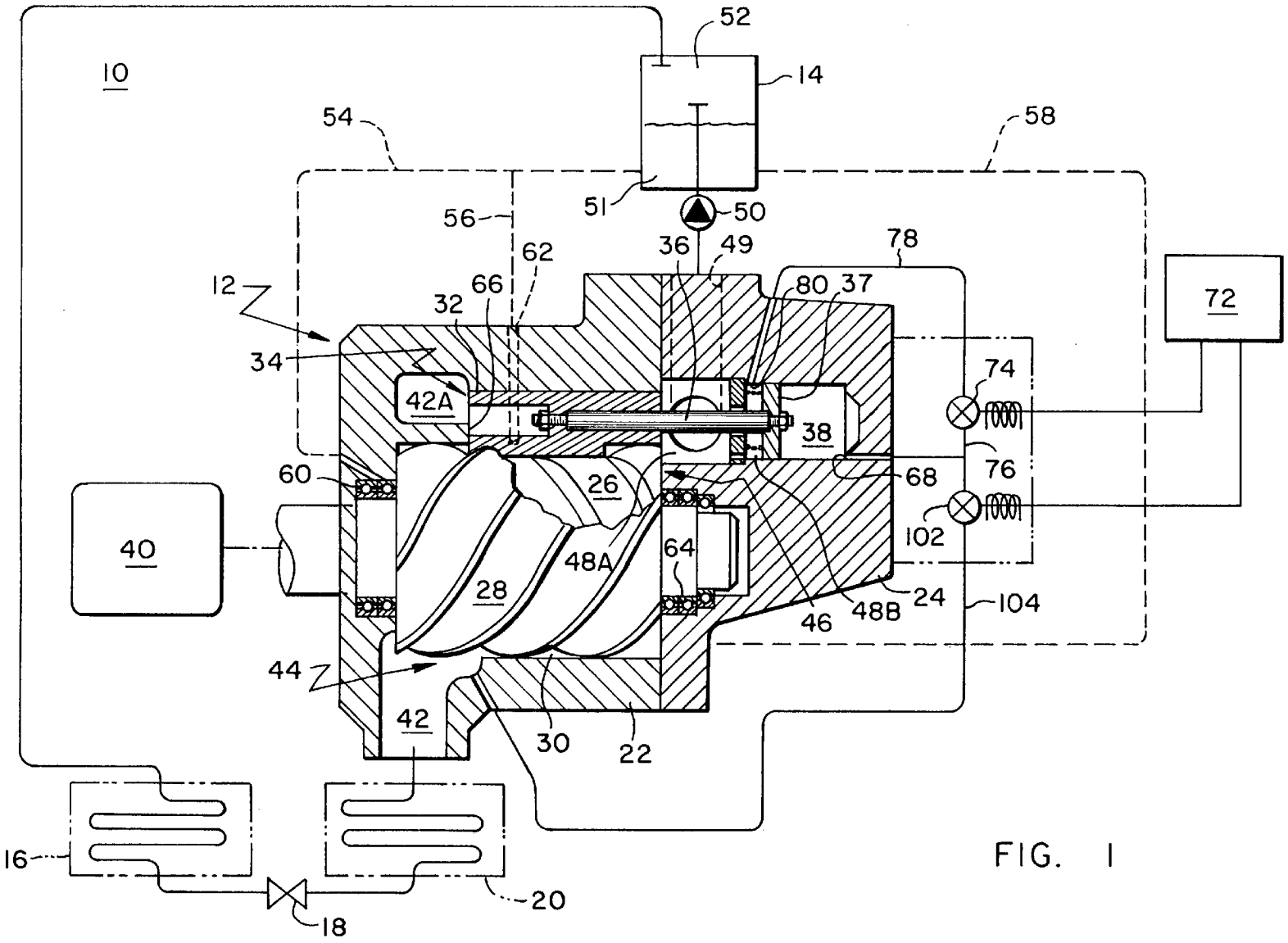
FIG. 1 is a cross-section/schematic view of the refrigeration system of the present invention and the slide valve arrangement for control of its screw compressor.
Figure 2:
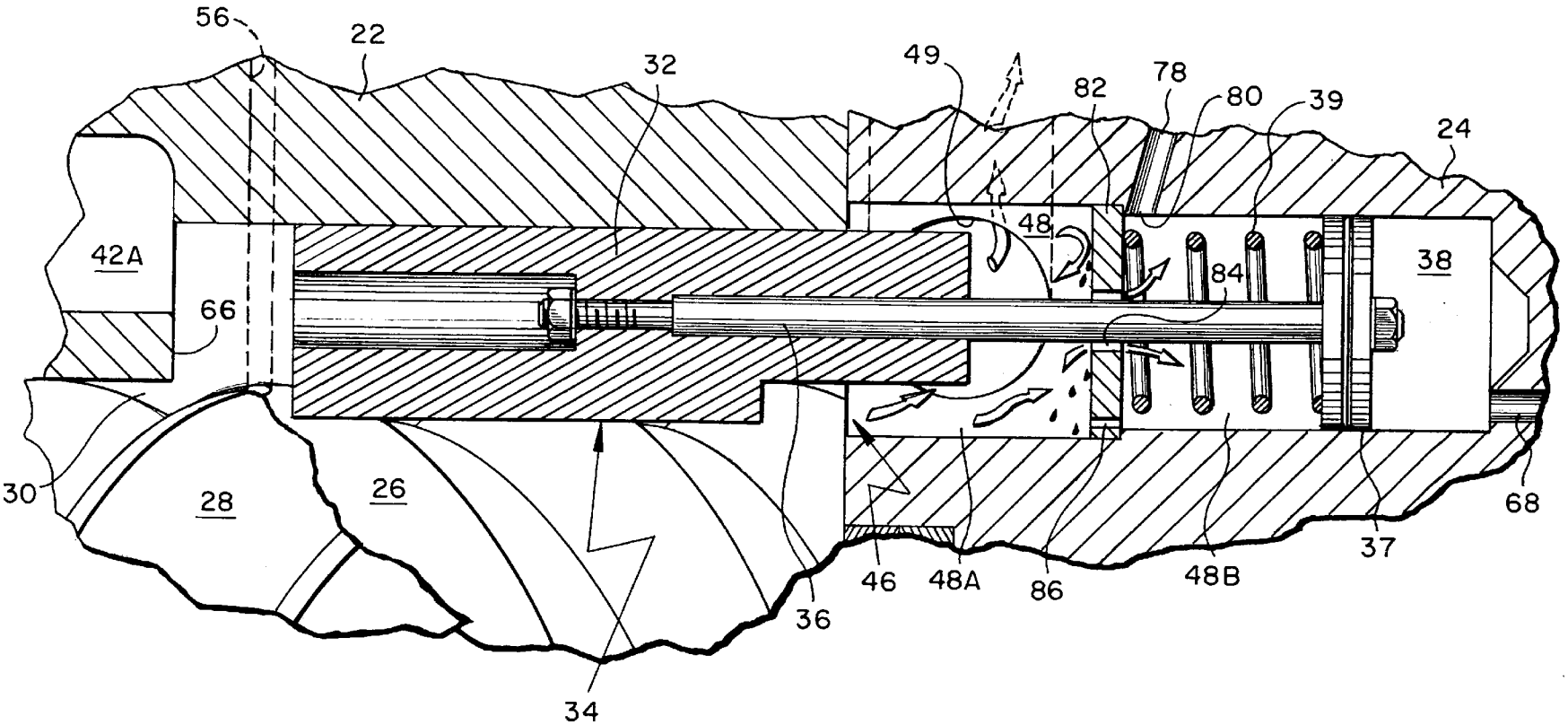
FIG. 2 is an enlarged view of the compressor portion of FIG. 1 better illustrating the slide valve assembly but in a part load rather than full load position.

Referring first to FIGS. 1 and 2, refrigeration system 10 is comprised of a compressor assembly 12, an oil separator 14, a condenser 16, a metering device 18 and an evaporator 20, all of which are serially connected for the flow of refrigerant therethrough. Compressor assembly 12 includes a rotor housing 22 and a bearing housing 24 which together are referred to as the compressor housing. A male rotor 26 and a female rotor 28 are disposed within the working chamber 30 of the compressor.

Working chamber 30 of the compressor is cooperatively defined by rotor housing 22, bearing housing 24 and valve portion 32 of slide valve assembly 34. Slide valve assembly 34 which, in the preferred embodiment, is a so-called capacity control slide valve assembly, is additionally comprised of connecting rod 36 and actuating piston 37. Piston 37 is disposed in slide valve actuating cylinder 38. A biasing member such as spring 39 (illustrated in FIGS. 2–4) may be disposed within actuating cylinder 38 to urge the slide valve assembly in a direction which unloads the compressor when actuating cylinder 38 is vented. One of male rotor 26 or female rotor 28 is driven by a prime mover such as an engine or electric motor 40.

Refrigerant gas at suction pressure is directed from evaporator 20 to communicating suction areas 42 and 42A defined in the low pressure end of compressor 12. Gas at suction pressure flows into suction port 44 within the compressor housing and enters a compression pocket defined between rotors 26 and 28 and the interior surface of working chamber 30. By the counter rotation and meshing of the screw rotors, the compression pocket is reduced in size and is circumferentially displaced to the high pressure end of the compressor where the then compressed gas is discharged from the working chamber through discharge port 46 into discharge passage 48.

With reference to discharge port 46 and to discharge ports in screw compressors in the general sense, discharge port 46 is comprised of two portions, the first being a radial portion which is formed on the discharge end of valve portion 32 of the slide valve assembly and the second being an axial portion which is formed in the discharge face of the bearing housing. The geometry and interaction of these discharge port portions with slide valve portion 32 of the slide valve assembly controls the capacity of compressor 12 and, in many respects, its efficiency.

In that regard, both the radial and axial portions of discharge port 46 affect compressor capacity until the slide valve assembly 34 unloads far enough such that the radial discharge portion is no longer located over the screw rotors. In that condition it is only the axial port which actively determines compressor capacity. Therefore, during compressor startup, when slide valve assembly 34 is in the full unload position, the axial portion of discharge port 46 will be the only active portion of the discharge port.

Discharge gas, having a significant amount of oil entrained in it, is directed out of discharge port 46, into discharge passage 48 and then into conduit 49. Discharge passage 48 is divided into two subareas 48A and 48B as will more thoroughly be described and as is illustrated in FIG. 2. Conduit 49 connects discharge passage 48 to oil separator 14 and may have a discharge check valve 50 disposed in it. Oil in the mixture delivered to oil separator 14 is separated therein and settles into sump 51.

Discharge pressure in the gas portion 52 of oil separator 14 acts on the oil in sump 51 to drive such oil into and through oil supply lines 54, 56 and 58 to various locations within compressor 12 that require lubrication, sealing and/or cooling. For example, oil supply line 54 provides oil to lubricate bearing 60 while supply line 56 directs oil to injection passage 62 in the rotor housing for sealing and gas cooling purposes. Supply line 58 directs oil to bearing 64 at the high pressure end of the compressor for lubrication purposes. These locations are, in turn, vented or drained to locations within the compressor that are normally at pressures lower than compressor discharge pressure and wherein refrigerant gas is found. As a result, the pressure of the discharge gas in the portion 52 of oil separator 14, even though it will have dropped in its flow from discharge passage 48 into the oil separator, will be sufficient to drive oil from sump 51 to the locations in compressor 12 in which it is used.

As will be appreciated, the position of slide valve actuating piston 37 within actuating cylinder 38 is determinative of the position of valve portion 32 of the slide valve assembly within rotor housing 22. Because of the relative surface areas of the faces of valve portion 32 and piston 37 that are exposed to discharge pressure in discharge passage 48 and because the end face of valve portion 32 which abuts slide stop 66 of the compressor is exposed to suction pressure while the face of piston 37 which faces into cylinder 38 is selectively acted upon by gas at discharge pressure, the admission of discharge pressure gas to actuating cylinder 38 through passage 68 causes slide valve movement in a direction which loads the compressor.

In FIG. 1, slide valve assembly 34 is illustrated in the full load position with valve portion 32 of the slide valve assembly in abutment with slide stop 66. In that position, working chamber 30 and the male and female screw rotors are exposed to suction pressure in suction area 42 only through suction port 44.

It will be appreciated that when slide valve assembly 34 is positioned such that valve portion 32 is moved away from slide stop 66, working chamber 30 and the upper portions of male rotor 26 and female rotor 28, in addition to being exposed to suction area 42 through suction port 44, are exposed to suction area 42A in the rotor housing. The exposure of upper portions of male rotor 26 and female rotor 28 to suction renders them incapable of participating in the definition of a closed compression pocket or participating in the compression process and the compressor's capacity is accordingly reduced. In FIG. 2, slide valve assembly is illustrated in such a part load position.

Figure 3:
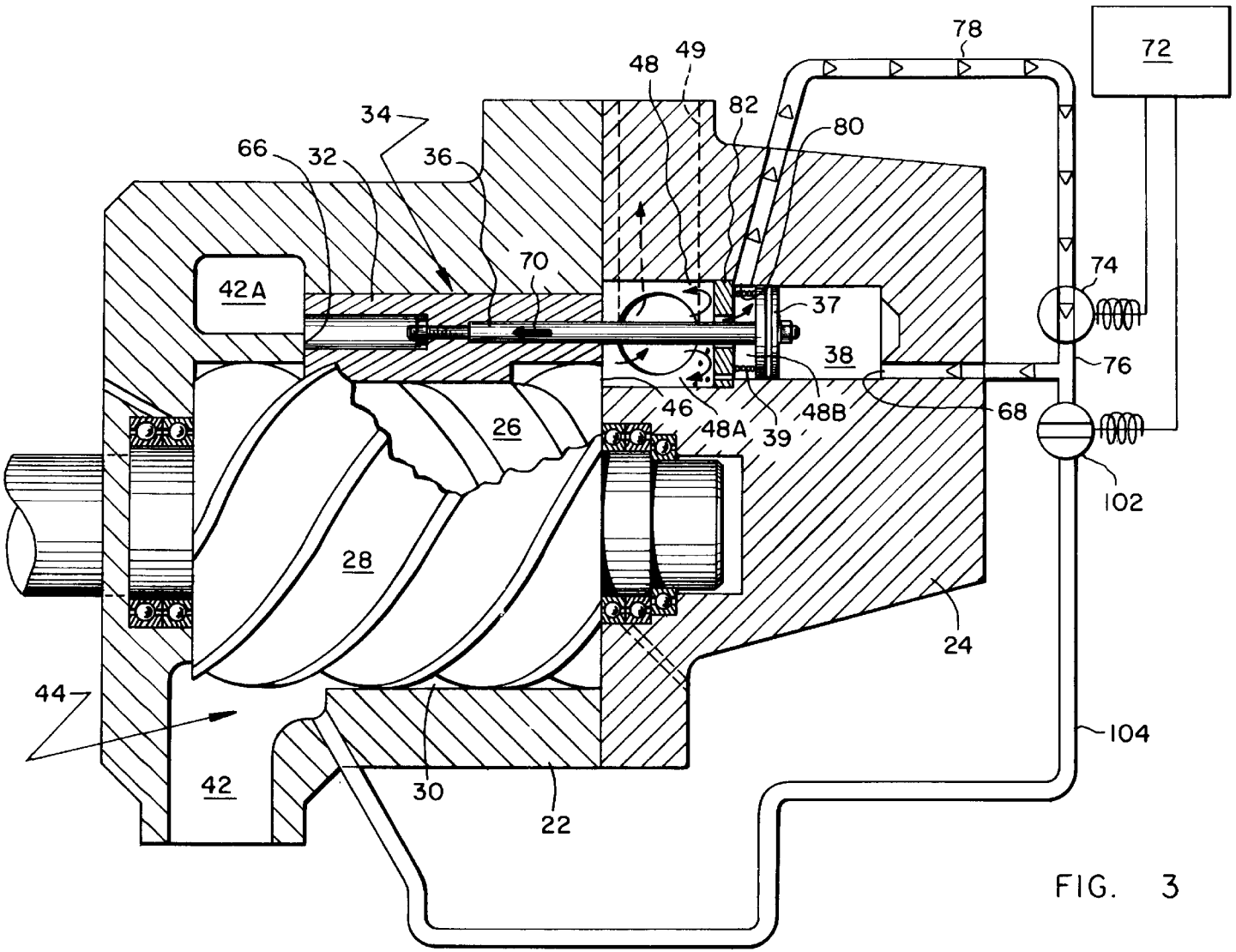
FIG. 3 is an enlarged view of the compressor of FIG. 1 illustrating an open load solenoid with the slide valve assembly in its full load position.
Figure 4:
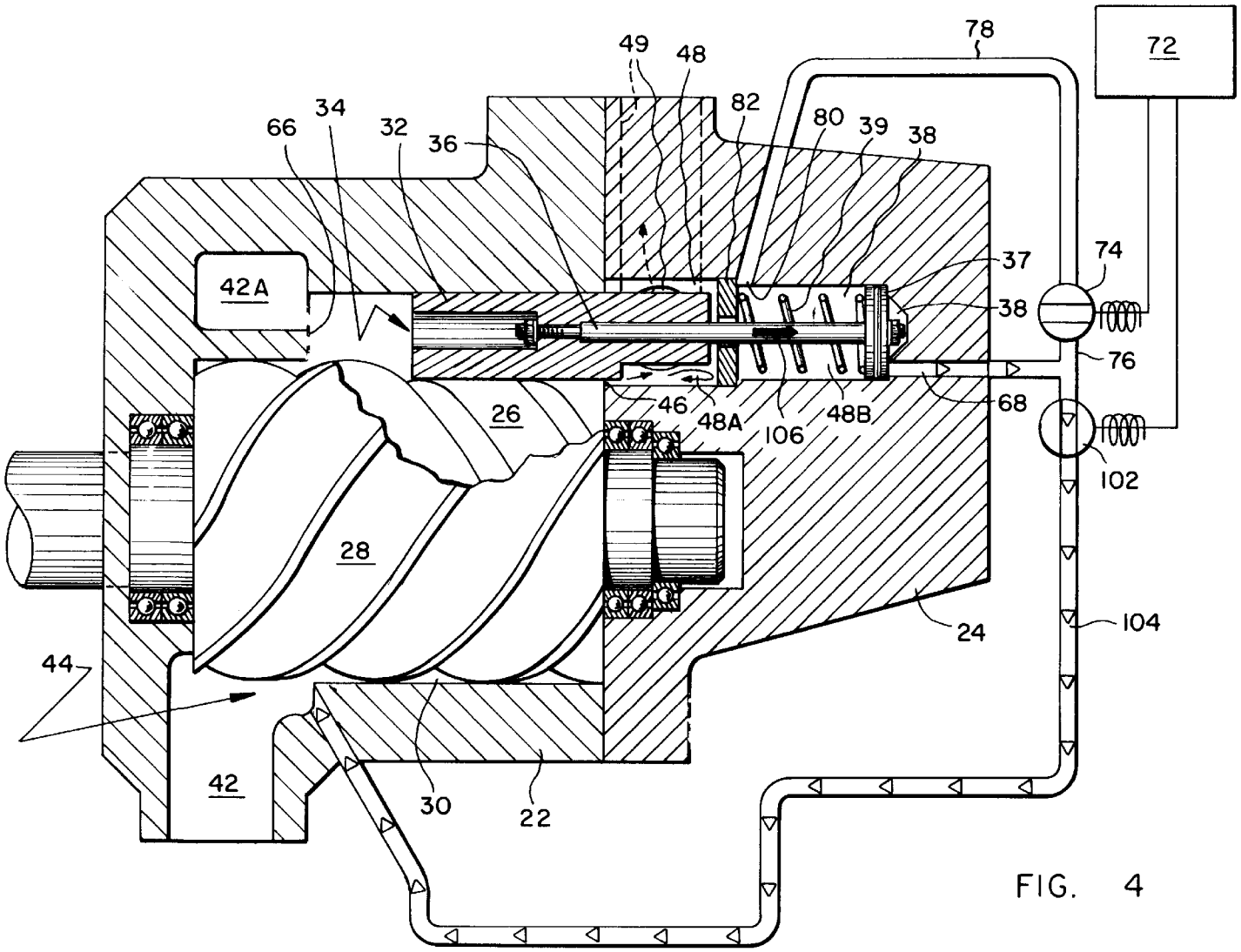
FIG. 4 is an enlarged view of the compressor of FIG. 1 illustrating an open unload solenoid and with the slide valve assembly in its full unload position.

Referring additionally now to FIGS. 3 and 4, controller 72 is electrically connected to load solenoid valve 74. Load solenoid 74 is in communication with slide valve actuating cylinder 38 via passage 76 and passage 68. Load solenoid 74 is further in communication with discharge passage 48 through passage 78.

Passage 78 opens into discharge passage 48 through aperture 80 where the content of discharge passage 48 will be gas which is relatively very free of entrained oil (as will be more thoroughly described) and which has undergone only nominal, if any, pressure drop subsequent to its discharge from the compressor's working chamber. As a point of clarification, discharge passage 48 is the variable volume between discharge port 46 and piston 37 while actuating cylinder 38 is the variable volume on the other side of piston 38 with the variance in the respective volumes being a function of slide valve position.

Referring primarily now to FIG. 2, it will be appreciated that by disposing a partition member 82 in discharge passage 48, discharge passage subareas 48A and 48B are formed. Partition 82, which defines an aperture 84 penetrated by rod 36 of the slide valve assembly, maintains discharge subarea 48B in communication with subarea 48A yet forms a barrier to the entry into subarea 48B of oil carried out of working chamber 30 in the discharge gas flow stream. As a result, subarea 48B is maintained at essentially the same pressure as subarea 48A when compressor 12 is in operation yet contains refrigerant gas which is essentially oil-free.

Aperture 84 of partition 82, as will be appreciated, is sized to assure freedom of slide valve movement but also to ensure that a constant supply of essentially oil-free discharge gas is available for slide valve actuation in which little, if any, pressure drop has occurred. Partition member 82 may define a weepage hole 86 which facilitates the draining or exiting of any small amount of oil which might make its way into subarea 48B through aperture 84. The movement of oil out of subarea 48B through hole 86 is facilitated by the sweeping movement of biasing member 39 and piston 37 when the slide valve assembly moves in a direction which loads the compressor.

Referring now to FIGS. 1, 2 and 3, refrigerant gas in which a significant amount of oil is entrained is discharged from working chamber 30 through discharge port 46 when compressor 12 in operation and enters discharge passage 48. The majority of the discharge gas flow stream, together with the oil entrained therein exits discharge passage 48 through conduit 49 and is communicated through discharge check valve 50 into oil separator 14. However, a quantity of the discharge gas that enters discharge passage 48 flows through aperture 84 of partition 82 and enters discharge subarea 48B.

Partition 82 serves as a barrier to the entry into discharge subarea 48B of the oil which entrained in the discharge gas flow stream that exits the working chamber of the compressor and, in effect, acts as means by which oil is separated from the discharge gas flow stream prior to its entry into discharge area 48B. Further, because of its proximity to discharge port 46, discharge passage subarea 48B contains discharge gas which is at the same or only a very nominally reduced pressure as compared to the pressure at which it exited working chamber 30 and is at a pressure higher than the pressure of the discharge gas in oil separator 14. In that regard, the pressure of the discharge gas in oil separator 14 will have dropped as a result of its travel through, around and into the system components and piping between discharge passage 48 and gas portion 52 of oil separator 14.

In order to assure that even the nominal amount of oil that might make its way through aperture 84 into discharge subarea 48B is not communicated out of subarea 48B into passage 78, aperture 80 of passage 78 opens into subarea 48B in its upper portion. Further, and as mentioned above, provision is made to sweep any such oil thereoutof through weepage hole 86 in the lower portion of subarea 48B, where any such oil will have settled, by the movement of spring 39 and piston 37 when compressor loading occurs.

It is to be appreciated, once again, that by sourcing slide valve actuation gas from discharge subarea 48B, gas is sourced for slide valve actuation purposes upstream of the flow paths and components within refrigeration system 10 that cause pressure drop within the discharge gas flow stream to occur. Among such flow paths and components are conduit 49, discharge check valve 50 and oil separator 14, all of which directly affect and cause pressure drop in the stream of refrigerant gas which flows out of the compressor's working chamber to the oil separator and beyond. Because slide valve actuation gas in the present invention is sourced from a location where it is essentially oil-free and where no or relatively only very nominal pressure drop in it has occurred, a homogeneous single source of gas, rather than multiple sources, is created for slide valve actuation purposes that can be relied upon under the foreseeable operating conditions that refrigeration system 10 is likely to experience. In previous systems, this has not been the case.

In operation and referring to FIGS. 1 and 3, whenever the refrigeration load on system 10 increases such that a demand to increase the capacity of compressor 12 comes to exist, controller 72 causes load solenoid 74 to open, as illustrated in FIG. 3, which places slide valve actuating cylinder 38 and piston 37 therein in flow communication with discharge subarea 48B through aperture 80, passage 78, passage 76 and passage 68. The admission of essentially oil-free gas at discharge pressure to actuating cylinder 38 causes slide valve assembly 32 to move in the direction of arrow 70 to load the compressor. Whenever compressor output matches the load on the refrigeration system, controller 72 causes load solenoid 74 to close which maintains the slide valve assembly in its then-current position. That may be a position, such as that illustrated in FIG. 2, which is intermediate the full load position illustrated in FIGS. 1 and 3 and the full unload position illustrated in FIG. 4 or may be the full load position of FIGS. 1 and 3.

At such time as the load on refrigeration system 10 decreases such that the capacity of compressor 12 can be reduced and still satisfy that load, controller 72 causes unload solenoid 102 to open, as illustrated in FIG. 4, which vents actuating cylinder 38 through passages 68, 76 and 104 to a location in the compressor or system in which it is employed, such as suction area 42, which is at a pressure lower than compressor discharge pressure. Venting of cylinder 38 in this manner causes the slide valve assembly to move away from slide stop 66 in the direction of arrow 106 under the impetus of spring 39 and the pressure in discharge area 48. Controller 72 closes unload solenoid 102 at such point as compressor capacity meets the demand on refrigeration system 10 or may permit slide valve assembly 34 to move to the full unload position of FIG. 4 when the shut-down of compressor 12 is called for or when the load on system 10 comes to be less than the very nominal capacity of the compressor that exists when the compressor is in its fully unloaded state.

By precisely and repeatably matching compressor capacity to the load on the refrigeration system in which the compressor is employed, the energy efficiency of the refrigeration system is optimized and wear and tear on the system compressor is reduced. Further, by providing a single source of gas for slide valve actuation purposes which is (i) reliably at a sufficient pressure under all foreseeable system operating conditions to actuate the slide valve by virtue of the fact it has undergone little or no pressure drop subsequent to its discharge from the compressor's working chamber and which is (ii) homogenous in nature by virtue of the fact that it is essentially oil-free, slide valve control complexities, compressor parts count and manufacturing costs are all reduced while consistent and repeatable slide valve movement is assured and overall system efficiency is enhanced.

While the present invention has been claimed in terms of a preferred embodiment, it will be appreciated that other embodiments, including capacity control valves of other than the slide type and screw compressors of other than the dual screw type, are contemplated and fall within its broader scope.

What is claimed is:

1. A screw compressor comprising:

a compressor housing, said housing at least partially defining a passage through which refrigerant gas passes for purposes of changing the capacity of said compressor and further defining a working chamber in which a refrigerant gas is compressed, lubricant coming to be entrained in said refrigerant gas within said working chamber during the compression process, a mixture of compressed refrigerant gas and lubricant being discharged from said working chamber when said compressor is in operation;

a source of compressed refrigerant gas located within said compressor housing, gas in said source having been discharged from the working chamber of said compressor;

a barrier disposed in said compressor housing and interposed between said working chamber and said source of compressed refrigerant gas, said barrier generally preventing the entry of lubricant carried in the gas discharged from said working chamber into the location of said source of compressed refrigerant gas so that the lubricant content of the gas in said source of compressed refrigerant gas is lower than the lubricant content of the mixture of refrigerant gas and lubricant as it is discharged from said working chamber; and a valve for changing the capacity of said compressor, said compressor capacity control valve being in flow communication with said source of compressed refrigerant gas through said passage which is at least partially defined by said compressor housing, said source of compressed refrigerant gas being the sole source of fluid for causing movement of said valve in a direction which loads said compressor.

2. The screw compressor according to claim 1 wherein a first and a second screw rotor are disposed in said working chamber, rotation of said first and said second screw rotors causing the compression of refrigerant gas within said working chamber.

3. The screw compressor according to claim 2 wherein said compressor defines a flow path by which the majority of the mixture of compressed refrigerant gas and lubricant discharged from said working chamber exits said compressor unaffected by said barrier.

4. The screw compressor according to claim 3 wherein said slide valve is actuated by a piston and wherein said housing defines an actuating cylinder, said slide valve piston being disposed in said actuating cylinder and partially defining the location of said gas source.

5. The screw compressor according to claim 4 wherein said housing cooperates in the definition of a discharge port out of which said mixture of compressed refrigerant gas and lubricant is discharged from said working chamber, said barrier being disposed downstream of the entry to said flow path by which the majority of said mixture discharged from said working chamber exits said compressor.

6. The screw compressor according to claim 5 wherein said barrier lubricant comprises a partition disposed in said housing, said partition partially defining the location of said gas source.

7. The screw compressor according to claim 6 wherein said capacity control valve is a slide valve and wherein a portion of said slide valve penetrates said partition and is moveable therethrough.

8. The screw compressor according to claim 7 wherein said partition defines an aperture, said aperture being penetrated by said slide valve and being sized to permit the entry of compressed refrigerant gas discharged from said working chamber of said compressor into the location of said gas source while forming a barrier to the entry of lubricant thereinto.

9. The screw compressor according to claim 8 wherein said passage at least partially defined by said compressor housing communicates between said gas source and said actuating cylinder.

10. The screw compressor according to claim 2 wherein said gas source is proximate said discharge port so that the gas within said gas source, having undergone little or no drop in pressure, is at essentially the same pressure as the pressure at which such gas exited said discharge port.

11. A method of controlling the position of a slide valve in a refrigeration screw compressor comprising the steps of:

discharging compressed refrigerant gas in which oil is entrained from the working chamber of said compressor;

disentraining, within said compressor, oil from a portion of said gas discharged from said working chamber;

defining a source location within said compressor, for refrigerant gas by which to cause the movement of said slide valve;

delivering gas from which oil has been disentrained within said compressor in said disentraining step to said source location so that said source location contains compressed refrigerant gas which has been discharged from said working chamber and which has relatively less oil by weight than does compressed refrigerant gas as it is discharged from said working chamber; and placing said source location in communication with said slide valve so as to move said slide valve by the use of refrigerant gas, said source location being the sole location from which refrigerant gas for moving said slide valve, to load said compressor is sourced.

12. The method according to claim 11 comprising the further step of locating said source location in said compressor where the pressure of gas discharged from said working chamber has undergone little or no pressure drop.

13. The method according to claim 12 wherein said disentraining step includes the step of defining a barrier to the passage of oil within said compressor, said barrier being upstream of said source location but downstream of said working chamber.

14. The method according to claim 13 comprising the further steps of defining an actuating cylinder within said compressor in which a piston is located, said piston being connected to said slide valve; and, defining a flow path from said source location to said actuating cylinder.

15. A refrigeration system comprising:

an oil separator;

a condenser;

a metering device;

an evaporator; and a screw compressor, said oil separator, said condenser, said metering device, said evaporator and said screw compressor all being connected for the serial flow of refrigerant therethrough, said compressor defining a working chamber and a source location for refrigerant gas downstream of said working chamber but in flow communication therewith, said compressor having a capacity control valve and a barrier disposed between said working chamber and said source location, said capacity control valve being caused to move so as to load said compressor by its exposure to compressed refrigerant gas that flows from said working chamber into said source location past said barrier, said barrier causing the disentrainment of oil from the stream of gas that issues from said working chamber so that refrigerant gas used to move said capacity control valve contains relatively less oil than refrigerant gas discharged from the working chamber of said compressor, said source location being the only location from which gas is sourced to move said capacity control valve to load said compressor.

16. The refrigeration system according to claim 15 further comprising means for communicating refrigerant gas from said screw compressor to said oil separator unaffected by said barrier, refrigerant gas discharged from the working chamber of said screw compressor undergoing pressure drop in its travel from said working chamber to said oil separator so that the relatively more oil-free refrigerant gas contained in said location within said compressor is at a pressure greater than the pressure of refrigerant gas in said oil separator.

17. The refrigeration system according to claim 16 wherein said screw compressor defines an actuating cylinder and wherein said capacity control valve is a slide valve, said slide valve having an actuating piston disposed in said actuating cylinder, said barrier being disposed intermediate said slide valve piston and said working chamber.

18. The refrigeration system according to claim 17 wherein said barrier comprises a partition, said partition being penetrated by said slide valve, said piston and said partition each at least partially defining said location within said compressor which contains refrigerant gas having relatively less oil than refrigerant gas discharged from the working chamber of said compressor.

19. The refrigeration system according to claim 18 wherein said compressor defines an interruptable passage between said actuating cylinder and said location within said compressor containing relatively oil-free refrigerant gas.

20. A refrigeration screw compressor comprising:

a housing, said housing having a barrier and defining a working chamber, a discharge port and a discharge passage, said discharge passage being in flow communication with said working chamber through said discharge port and having first and second subareas, said barrier being interposed between said first and said second subareas, lubricant coming to be entrained in refrigerant gas which undergoes compression in said working chamber, such gas being discharged from said working chamber through said discharge port into said first subarea of said discharge passage, a portion of such gas making its way past said barrier into said second subarea, said barrier preventing the entry, into said second subarea, of a portion of the lubricant entrained in said refrigerant gas prior to its entry into said second subarea so that the amount of lubricant contained in the refrigerant gas in said second subarea is relatively less than the amount of lubricant contained in the refrigerant gas in said first subarea;

a first screw rotor disposed in said working chamber;

a second screw rotor disposed in said working chamber; and a capacity control slide valve, said slide valve being actuated by a piston, the actuation of said piston being by exposure of said piston to refrigerant gas in said second subarea of said discharge passage, said second subarea being the sole source of fluid by which said slide valve is actuated so as to load said compressor.

21. The refrigeration screw compressor according to claim 20 wherein said barrier comprises a partition in said discharge passage, said partition dividing said discharge passage into said first and said second subareas.

22. The refrigeration screw compressor according to claim 21 wherein said housing defines a slide valve actuating cylinder, said slide valve actuating cylinder being in selective flow communication with said second subarea of said discharge passage.

23. The refrigeration screw compressor according to claim 22 wherein said partition defines an aperture, said aperture being penetrated by said slide valve.

24. The refrigeration screw compressor according to claim 23 further comprising biasing means disposed in said second subarea for urging said slide valve in a direction which unloads said compressor when said slide valve actuating cylinder is vented.

25. A refrigeration system comprising:

an oil separator;

a condenser;

a metering device;

an evaporator;

a screw compressor, said oil separator, said condenser, said metering device, said evaporator and said screw compressor all being connected for serial flow of refrigerant therethrough, said compressor defining a working chamber out of which compressed refrigerant gas in which oil is entrained flows and having a capacity control valve, said capacity control valve being caused to move so as to load said compressor by exposure of said valve to compressed refrigerant gas sourced from a location within said compressor, said source location for refrigerant gas being downstream of the discharge port of said compressor but upstream of said system oil separator and containing only refrigerant gas that has passed out of said working chamber through said discharge port, compressed refrigerant gas flowing from said working chamber to said oil separator decreasing in pressure enroute from said working chamber to said oil separator so that refrigerant gas in said source location is generally at a higher pressure than refrigerant gas in said oil separator; and a barrier interposed between said working chamber and said source location, said barrier preventing the flow of at least a portion of the oil entrained in the refrigerant gas that flows into said source location so that refrigerant gas in said source location is at a pressure higher than the pressure of refrigerant gas in said oil separator, when the compressor is in operation, and contains relatively less entrained oil than refrigerant gas as it is discharged from the working chamber of said compressor.

26. The refrigeration system according to claim 25 wherein said source location is the only location in said refrigeration system from which refrigerant gas is capable of being sourced for purposes of causing said capacity control valve to move so as to load said compressor.

27. The refrigeration system according to claim 26 wherein said source location is in flow communication with but shielded from refrigerant gas issuing from said discharge port by said barrier, the shielding of said source location by said barrier acting to disentrain lubricant from discharge gas issuing from the working chamber of said compressor prior to the entry of such gas into said source location.

28. The refrigeration system according to claim 26 wherein said screw compressor defines a discharge port and wherein said source location is adjacent said discharge port.

29. The refrigeration system according to claim 26 wherein said screw compressor has a rotor housing and a bearing housing, said rotor housing and bearing housing cooperating in the definition of said discharge port, said source location being in said bearing housing.

30. A method of controlling the position of a slide valve in a screw compressor in a refrigeration system having an oil separator located downstream of the compressor, comprising the steps of:

discharging compressed refrigerant gas in which oil is entrained from the working chamber of said compressor through a discharge port;

flowing the majority of the gas discharged in said discharging step and in which oil is entrained to said oil separator;

delivering a portion of the gas discharged in said discharging step to a source location in said refrigeration system, said source location being downstream of said discharge port but upstream of the oil separator, the pressure of the refrigerant gas in said source location being greater than the pressure of refrigerant gas in said oil separator, said source location being the only location from which gas is sourced to cause the slide valve of said compressor to move so as to load said compressor; and selectively placing said source location in flow communication with said slide valve when the load on said refrigeration system is such as to require that said compressor produce compressed refrigerant gas at a higher capacity.

31. The method according to claim 30 comprising the further step of disentraining lubricant from the compressed refrigerant gas delivered to said source location in said delivering step, such disentrainment occurring prior to said delivery step and other than in said oil separator, so that the refrigerant gas in said source location contains relatively less oil by weight than both refrigerant gas as it is discharged from the working chamber of said compressor and as it enters said oil separator.

32. The method according to claim 31 wherein said disentraining step occurs and wherein said source location is within said compressor.

* * * * *